US005538632A

United States Patent [19]

Gero et al.

[11] Patent Number: 5,538,632

[45] Date of Patent: Jul. 23, 1996

[54] MULTIPLE FILTER DYNAMIC WASHER

[75] Inventors: William A. Gero; Goda Rangamannar; Luigi Silveri, all of Pittsfield, Mass.

[73] Assignee: Beloit Technologies, Inc., Wilmington, Del.

[21] Appl. No.: 144,076

[22] Filed: Oct. 28, 1993

[51] Int. Cl.[6] ..... B01D 24/00

[52] U.S. Cl. ..... 210/338; 162/60; 162/55; 210/336; 210/314; 210/415; 68/148; 68/181 R

[58] Field of Search ..... 210/415, 414, 210/336, 337, 338; 68/181 R, 148; 209/305, 306, 273; 162/60, 57, 55, 56, 380, 55

[56] References Cited

U.S. PATENT DOCUMENTS

| | | | |
|---|---|---|---|
| 46,030 | 1/1865 | Sellers . | |
| 539,412 | 5/1895 | Cadwgan . | |
| 569,673 | 10/1896 | Roach . | |
| 1,468,337 | 9/1917 | Winestock . | |
| 1,990,992 | 2/1935 | Lang et al. . | |
| 2,367,961 | 1/1945 | Piponius | 210/338 |
| 2,649,371 | 8/1953 | Reid . | |
| 3,111,832 | 11/1963 | Eberhardt . | |
| 3,223,239 | 12/1965 | Dick | 210/338 |
| 3,275,150 | 9/1966 | Tait | 210/338 |
| 3,363,759 | 1/1968 | Clarke-Pounder . | |
| 3,437,204 | 4/1969 | Clarke-Pounder . | |
| 3,545,621 | 12/1990 | Lamort | 210/338 |
| 3,595,038 | 7/1971 | Bergholm . | |
| 3,735,873 | 5/1973 | Bergstedt . | |
| 3,785,495 | 1/1974 | Holz | 210/338 |
| 3,807,202 | 4/1974 | Gunkel . | |
| 3,912,622 | 10/1975 | Bolton | 209/306 |
| 4,043,919 | 8/1977 | Hutzler . | |
| 4,067,800 | 1/1978 | Young | 209/273 |
| 4,076,623 | 2/1978 | Golston . | |
| 4,215,447 | 8/1980 | Gartland et al. . | |
| 4,396,502 | 8/1983 | Justus . | |
| 4,529,479 | 7/1985 | Tuomi . | |
| 4,855,038 | 8/1989 | LeBlanc . | |
| 5,255,540 | 10/1993 | LeBlanc et al. . | |

FOREIGN PATENT DOCUMENTS

| | | |
|---|---|---|
| 0039563 | 9/1973 | Australia . |
| 0337432 | 10/1989 | European Pat. Off. . |
| 1571653 | 6/1969 | France . |
| 2009274 | 9/1978 | United Kingdom . |
| 9200413 | 1/1992 | WIPO . |

OTHER PUBLICATIONS

Crotogino/Poirier/Trinh, "The Principles of Pulp Washing" Jun. 1987, pp. 95–103, Tappi Journal.

*Primary Examiner*—Brenda A. Lamb
*Attorney, Agent, or Firm*—Dirk J. Veneman; Raymond W. Campbell

[57] ABSTRACT

A pressurized dynamic pulp washer including an annular hollow housing in which the stock is driven axially along a plurality of stationary, annular, coaxial wash filters in axially reversible directions, with an annular rotatable shell between the wash filters to urge liquid through openings in the filters, to generate axial, radial and circumferential velocities in the slurry to create localized pulses in the slurry to urge liquid through the filters with wash liquid being introduced to replace liquid filtered from the fibers in the slurry.

13 Claims, 2 Drawing Sheets

MULTIPLE FILTER DYNAMIC WASHER

BACKGROUND OF THE INVENTION

The present invention generally relates to improvements in fiber processing, and more specifically to improvements in methods and apparatus for washing cellulose pulp fibers to be used in the manufacture of paper.

When wood is chemically processed to obtain cellulose pulp fibers for papermaking, the process includes cooking or digesting wood chips with various pulping liquors so that the resins and materials binding the cellulose fibers together are dissolved in the pulping liquor, thereby liberating the fibers. The result is a slurry of fibers suspended in a liquid of spent chemicals or liquor. To further prepare the pulp for papermaking, the fibers must be separated from the liquid, the liquid removed and the fibers washed to remove what chemicals remain with the fiber.

PRIOR ART

The goal of pulp washing is to separate soluble and insoluble impurities from the pulp fiber, to obtain pulp essentially free from impurities. An optimum pulp washing system would remove waste liquor and other impurities completely, while using only a minimal amount of wash liquid. For chemical recovery and/or other subsequent waste liquor processing, any wash fluids added during the washing stage must also be treated, either by evaporation or by other means. Therefore, it is desirable to minimize the amount of wash fluid added during the washing process, to minimize dilution of the pulping liquors and the subsequent cost of reprocessing the chemicals in subsequent treatment stages.

In evaluating the efficiency of washing systems, the papermaking industry has adopted the term "dilution factor" to define the amount of wash fluid used. The dilution factor can be described as the amount of water or other wash liquid put into the system and not taken out of the system with the washed pulp as the pulp is removed from the system. If the quantity of wash fluid added is equal to the quantity of wash fluid passing from the system with the pulp, the dilution factor is zero. Low dilution factors are, therefore, most desirable.

Methods used heretofore for the washing of cellulose stock are discussed below:

Dilution—Agitation—Extraction (Extraction Washing)

In this washing process, excess liquor is drained from the pulp, and the pulp is diluted with water and/or weaker liquor from a following stage. The mixture is thoroughly agitated to promote equilibrium. The mixture is then again dewatered to a predetermined extent. The process efficiency is related to the degree of equilibrium reached in the agitation cycle, and the degree of extraction between successive dilution stages. Compaction may be used to enhance the extraction stage. The removal of solids and weak black liquor concentrations in extraction washing is dependent on the inlet and discharge consistencies of the pulp for a given dilution factor.

Extraction washing systems usually require a plurality of extraction stages to accomplish acceptable washing results, and have inherently high dilution factors. Present day chemical recovery practices and environmental standards have reduced the acceptance of this washing technique.

Displacement Washing

In this method, the liquor within the slurry void spaces is displaced with wash water and/or filtrate from following stages. Diffusion of the wash liquid through the pulp is controlled to avoid mixing. The process efficiency is related to the degree of mixing and channeling that occurs during displacement, which decreases efficiency, and the degree of equilibrium reached between pulp fibers and liquor pockets and wash liquor.

Methods for performing displacement washing have included forming a mat of the stock on the top surface of a rotating perforated drum or a traveling belt and spraying the displacement liquid onto the top of the mat. The liquid passing through the belt is removed from beneath the belt. A substantial disadvantage in this type of arrangement has been the creation of foam and froth on the top of the wire, which has to be removed and handled. Further, protective hoods or canopies have to be provided to handle the spray.

Dilution—Extraction—Displacement

This method utilizes combined operations of the previous two methods, and its efficiency is dependent on the variables affecting the operation of each. Approximately 85% of the Kraft pulp mills today use this method for pulp washing. The pulp is diluted with the liquor from the following stage, and is agitated to promote equilibrium. Extraction occurs, followed by the displacement of the liquor remaining in the pores. Drum washers, either pressurized or under vacuum, have been used to perform this washing method. As with the earlier described methods, with respect to the washing surface, the pulp fibers are more or less in a static state as the extraction and displacement occur.

Some of the difficulties with this method include the negative effects of entrained air in the pulp and, in the case of vacuum washers, the limitations on washing temperature. Generally, drainage of liquor through a pulp mat improves with elevated temperatures, and higher temperatures therefore improve washing efficiency. However, vacuum washers, which operate at up to −5 psi in the drum, create lower equilibrium temperature conditions. Therefore, it is not possible to significantly raise the operating temperature of vacuum washers to further improve the drainage characteristics of the pulp.

Pressure washers operating similarly to vacuum washers, but with a positive pressure in a hood above the pulp mat, have overcome, to some degree, the temperature limitations of vacuum washers. However, as with vacuum washers, the stock surface is exposed to air, and the ability to control the washing process by the stock pressure is lost. Further, air entrainment in the stock is significant, and foam resulting from the entrained air, at times, is difficult to control. Air in the pulp reduces the efficiency of subsequent wash stages, further increasing the washing capacity required to reach the desired degree of washing. Defoaming agents are helpful, but add cost and present additional handling and disposal problems.

Previously known washing techniques employing extraction or displacement have maintained relatively static relationships between the fibers being washed and the retention surface through which the separation occurs. Typically, today, this includes the formation of a mat on a wire, drum or the like. As the liquid is removed, the mat is stationary with respect to the drum or wire. The resulting relatively slow extraction or displacement requires equipment to be large for adequate capacity. Therefore, capital expense for equipment and space requirements are large.

One arrangement has employed a continuously operating mechanism wherein a slurry of pulp is moved in one direction over a cylindrically shaped screen. However, the capacity of such devices has been limited and the consumption requirements of present day papermaking machines require pulp washers which can operate continuously with a high capacity in order to handle demands.

OBJECTS OF THE PRESENT INVENTION

An object of the present invention is to provide a continuously operating pulp washer and improved method for washing pulp which offers substantial advantages over devices heretofore available in that it provides substantially increased capacity in output without increase in floor space requirements.

An object of the present invention is to provide a continuously operating mechanism and method for the washing of cellulose stock which avoids disadvantages of methods and structures heretofore available, and which is capable of performing a washing operation without the generation of froth and foam.

A further object of the present invention is to provide an improved stock washing mechanism and method which improves the quality of the stock being washed, and which utilizes the carrier liquid in the stock for washing and subjects the fibers to a continuous reslushing and rewashing process with agitation while addition of fresh wash liquid is minimized, resulting in a minimum dilution of the liquor.

A still further object of the present invention is to provide a stock washer which has an improved arrangement for handling the liquors and liquid and an improved arrangement for removing the stock fibers.

Another object of the present invention is to provide a stock washer operating under a pressurized atmosphere to handle high temperature stock and also to improve the washing operation efficiency.

Yet another object of the present invention is to provide a stock washing apparatus which keeps the stock under high turbulence at high consistency for improved washing operation efficiency.

Still another object of this invention is to provide a stock washing apparatus and method which increase the capacity of a given unit and thus reduce the area required for washing equipment and which achieve economy of piping and pumping, and decreased capital investment for washing equipment in comparison with existing washing techniques of a given degree of washing.

SUMMARY OF THE INVENTION

The present invention provides a method and unique apparatus for washing pulp stock in an enclosed atmosphere under pressurized conditions wherein stock is driven along a stationary washer filter by the pressure differentials between the stock inlet and the stock outlet of the washer. Sequential washer filters are provided, annularly shaped, wherein the stock is passed in a first axial direction along one filter and then reversed to pass in an opposite axial direction along the other filter. A unique annular shell extends between the filters driven in rotation to define the path of flow of the pulp and simultaneously to generate high frequency low amplitude pulses in the stock. The shell also simultaneously creates an axial, radial and annular or tangential velocity in the stock from the inlet to the outlet enhancing flow of wash liquid through the filters. With the provision of two or three annular filters, and plural annular rotating shells, substantially increased capacity is obtained with satisfactory or even enhanced dewatering of the fibers. Fresh wash liquid can be admitted to the stock between wash filter sections to replace liquor drained from the fibers.

Other objects, advantages and features of the invention, as well as alternative embodiments of the structures and method, will become more apparent with the teaching of the principles of the invention in connection with the disclosure of the preferred embodiments in the specification, claims and drawings, in which:

DETAILED DESCRIPTION OF THE PREFERRED EMBODIMENTS

Figure 1:
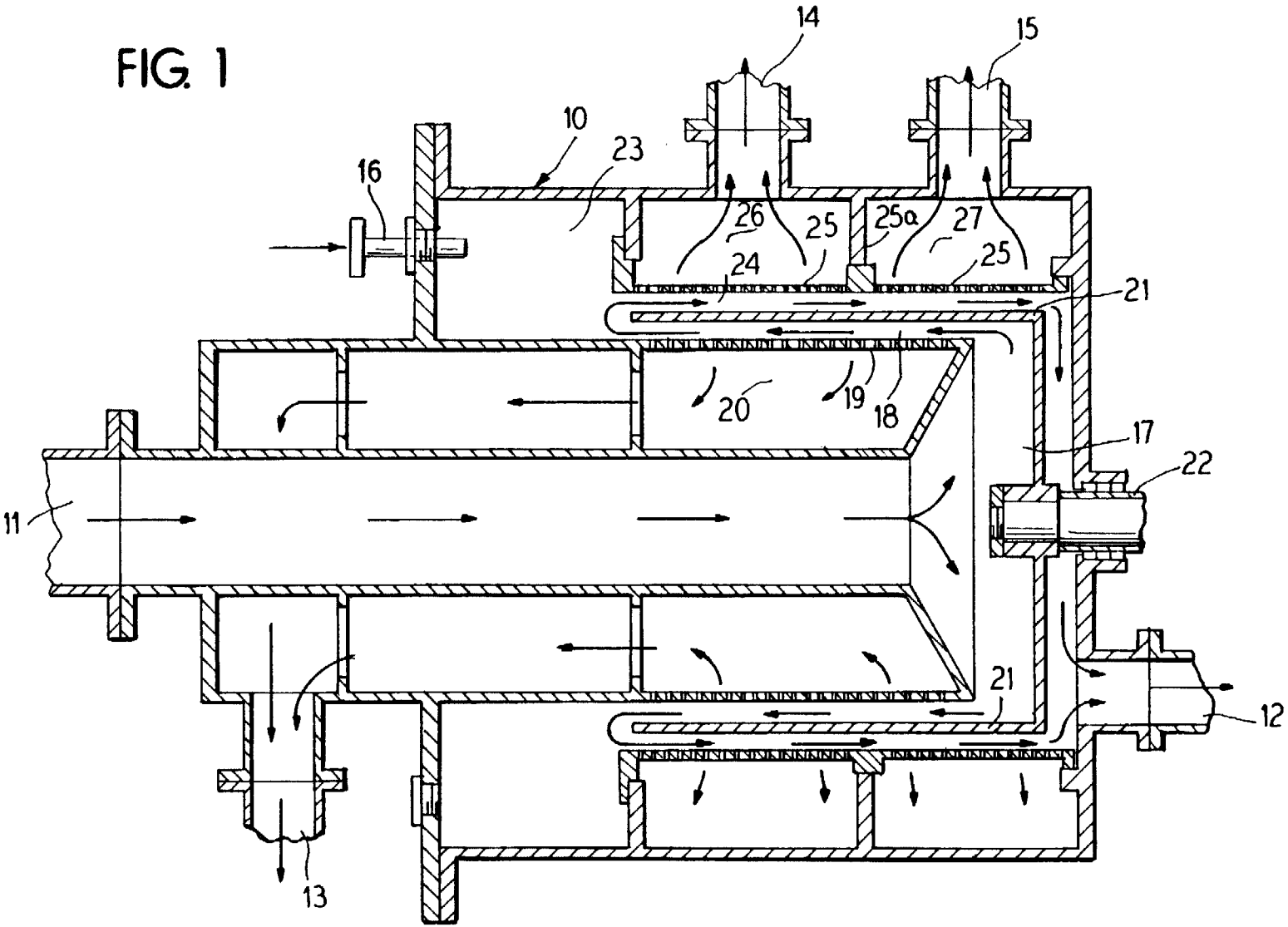
FIG. 1 is a vertical sectional view taken through the axis of a pulp washing device constructed and operated in accordance with the principles of the present invention.

As illustrated in FIG. 1, an annular housing 10 is provided having pressurized chambers therein for receiving a flow of stock slurry which is admitted at an inlet 11 into the housing. Washed stock is discharged from the housing through a stock outlet 12.

Arrowed lines are included on the drawing to show the flow of stock and filtrate through the housing as the stock fibers are washed.

Within the housing are first and second wash filters 19 and 25 which will operate to sequentially pass liquid extracted from the stock fibers as the stock fibers move in the pressurized channels through the housing. Filters 19 and 25 are annular, perforate bodies, coaxially positioned, with filter 19 being disposed radially within, but spaced from filter 25.

As the stock slurry enters the housing at 11, it flows axially to an open chamber 17, where it is redirected radially outwardly to flow in an opposite axial direction through an annular passage 18. In the annular passage 18, the slurry flows past the openings of the first filter 19. Liquid flows from the slurry of fibers from the first or outer side of the filter 19 to the second or inner side and into a chamber 20, where the liquid flows axially and then radially to a liquid outlet 13. The liquor passing through the wash filter 19 leaves the fibers and the fibers become more concentrated as they flow axially through the annular chamber 18.

The radial outer boundary or wall of the annular passage 18 is formed by an annular shell 21, which is coaxial with the annular filter 19 and is mounted on a rotor 22. The rotor and shell are driven in rotation by drive means not shown. The shell may have a profiled surface or surfaces to transfer rotational acceleration to the stock.

The shell rotation generates a low frequency turbulence and mixing of the slurry along the washing surface. To aid in this, a plurality of projections are mounted on both radial surfaces of the shell as illustrated in FIG. 3. The shell has shaped projections 28 on its radial outer surface and projections 29 on its radial inner surface. These projections may take various desired shapes, but advantageously may be semi-spherical extend along the full axial length of the shell. The projections are shown in detail in FIG. 3 only, and omitted for clarity of the illustration in FIGS. 1 and 2.

The rotating shell functions to aid in providing a velocity in the slurry, which velocity has components that are axial and circumferential or tangential. The axial velocity in the slurry is generally provided by the pressure differential between the inlet 11 through which the slurry flows upon entering the washer and the outlet 12 through which the washed stock flows upon leaving the washer. The rotation of the shell 21 induces a rotational or a tangential velocity. Radial velocity is provided by the pressure differential across the filters, and the superimposed pulses from the profiled surface of the rotor shell.

As the slurry flows axially between the filter 19 and the shell 21, the flow being to the left as shown in FIG. 1, the slurry reaches a washing chamber 23 wherein washing liquid may be added through an inlet wash liquid line 16. The wash liquid mixes with the fibers and aids in replacing liquor withdrawn from the fibers in its passage through the axial path 18. The slurry then reverses flow direction, as shown by the arrowed line, and flows axially in an opposite direction along an annular, axially extending passage 24. The passage 24 is defined between the outer surface of the shell 21 and annular filter 25. The filter 25 is shown as being two circumferential bands separated by a wall **25*a*, and the liquid flows from the fibers through the wires into chambers 26 and 27 out of the washer through pipes 14 and 15. The shell 21, driven in rotation, generates circumferential and radial velocities in the stock, and an axial velocity is generated by the pressure differential between the inlet 11 and the outlet 12**.

As shown and described in this embodiment, in a housing 10 which consumes relatively little space, the stock slurry has made two full axial passages through the housing and has been subjected to two full length axial travels past filters 19 and 25. The washed stock then travels out through the outlet 12.

Figure 2:
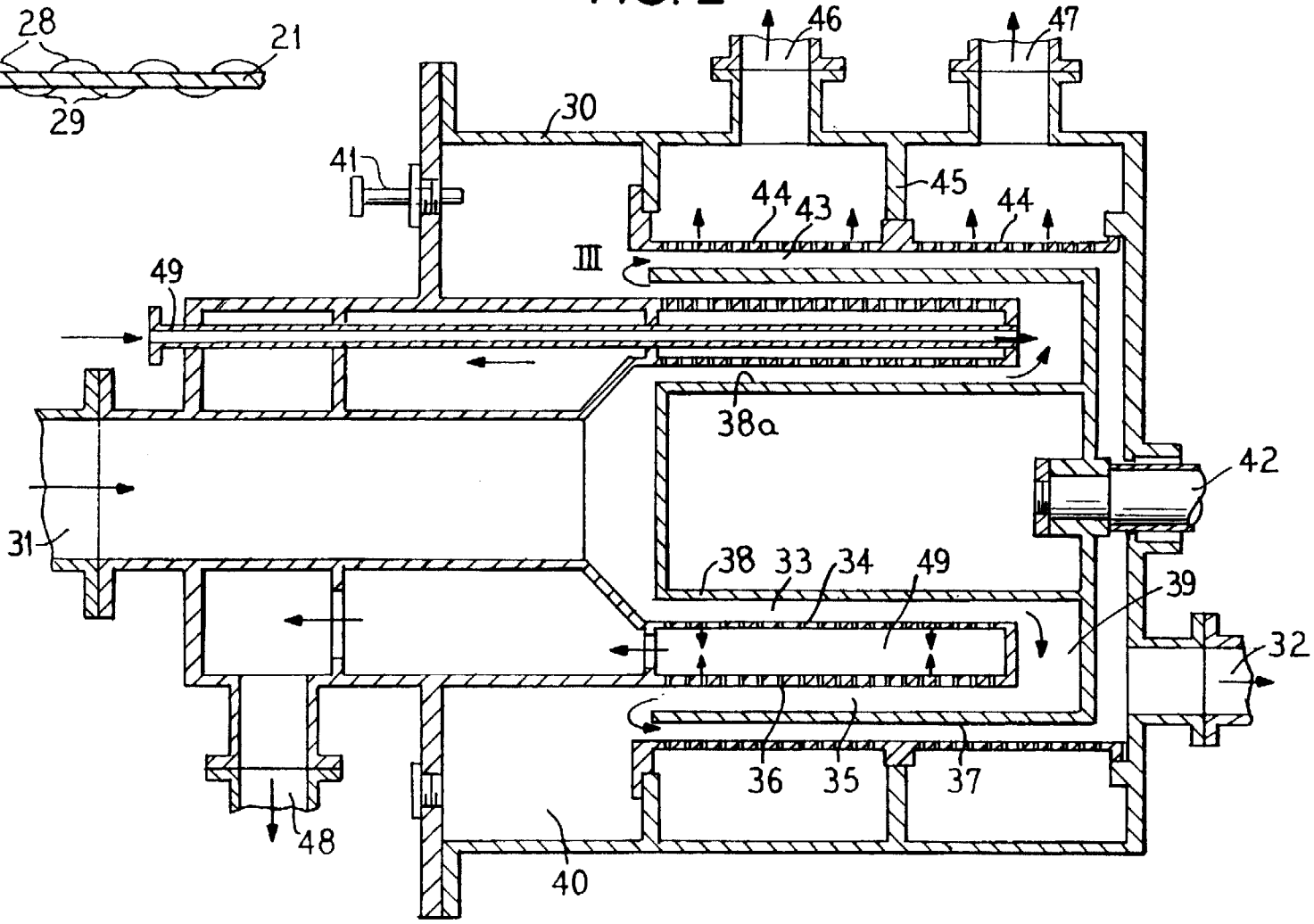
FIG. 2 is another vertical sectional view taken along the axis of a washing device providing certain modifications over the structure of FIG. 1 and operating in accordance with the principles of the invention.
Figure 3:
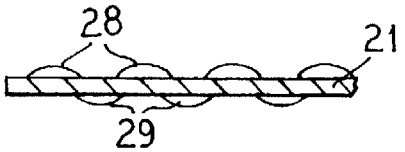
FIG. 3 is an enlarged fragmentary view of details of the rotating shell.

Referring now to FIG. 2, due to the pressure differential between an inlet 31 and an outlet 32, slurry flows through the chambers within an annular housing 30.

As the slurry enters the annular housing through the inlet 31, it flows through an annular passage 33 formed between an annular wash filter 34 and a first or inner shell 38. At the end of its axial travel past the inner side of the filter 34, to the right as shown in FIG. 2, the slurry is redirected in the chamber 39 to flow in the opposite axial direction through an annular passage 35 formed between an annular wash filter 36 and a second outer annular shell 37. The shells 37 and 38 are mounted on a common rotor 42 and are driven in rotation. The shells have projections arranged in the manner illustrated in FIG. 3. The inner shell 38, which is drum-like in configuration has projections on its outer surface **38*a*, and the annular shell 37 has projections on both its inner and outer surfaces as illustrated in FIG. 3**. The projections introduce pulses in the slurry, aiding in inducing dewatering through the wash filters. Also, the rotating shells aid in providing circumferential or tangential velocity, as well as a radial velocity to the slurry passing over the surfaces of the shells.

As the slurry is redirected in the chamber 39, and flows axially through the passage 35, the liquor filtered from the slurry flows into an area 49 between the wires and flows axially out of the washer through an outlet 48. If desired, washing liquid may be introduced into the compartment 39.

After flowing through the passage 35, the axial flow direction of the slurry is again reversed to flow through the axial annular passage 43, past a two-part wash filter 44. The wash filters 44 are supported on an annular wall 45, and the liquid washed from the fibers flows out from chambers behind the filter 44 through pipes 46 and 47. Prior to the slurry reversing and flowing into the passage 43, it flows through a wash dilution chamber 40 where wash liquid can be introduced through a line or lines 41.

In the embodiment shown and described with respect to FIG. 2, the fiber flows past three wash surfaces, and is subjected to significant washing affect in minimal equipment area.

Thus, in each of the arrangements shown in FIGS. 1 and 2, the flow of stock through the annular housing is induced by the pressure differential created between the inlet and outlet, and the pressure of the slurry forces the filtrate through the washer filters. The fibers being influenced by the velocities induced therein, both axial and tangential, will not pass through the filter openings, which would allow fiber passage if the fibers were influenced only by radial velocity. The stock inside the washer reaches higher consistency than the inlet consistency due to the extraction of liquid. The introduction of wash liquid replaces some of the extracted liquid and continues to wash the fibers, thus removing soluble and insoluble impurities.

The stock in the sequential washing zones is exposed to repeated washing procedures, which include dilution, mixing, extraction and displacement. The process efficiency depends upon the degree of equilibrium reached in mixing and the degree of extraction displacement achieved under the particular operation condition of the washer. A high degree of mixing is achieved in the washer due to the operation of the rotor, which drives the shell or shells in rotation in close proximity to the wash filters. This quickly produces a uniform concentration of solute at any point of the washer when a high solute concentrate liquid in the stock is mixed with a low solute concentrate liquid or fresh water. The liquor, after reaching equilibrium concentration, is extracted through the filter. The slurry flowing through the cylindrical housing is subjected to repeated washings, with the repeated axial reversing which is allowed to take place.

The shell rotors not only induce a pulse turbulence in the slurry but also induce circumferential velocity in the fibers in the slurry, ensuring their continued passage past the openings of the filters which function to drain the liquid washed from the fibers. The preferred arrangements shown provide either two or three axial reverses and passages through the equipment, and it will be understood that additional arrangements providing four or more passes could be employed, although high efficiency has been achieved with the arrangements shown.

In trials, as contrasted with a mechanism utilizing a single wash filter within a mechanism, the hydraulic capacity of a machine of the instant invention was increased by at least 50%, while running at 450 gallons per minute of flow as compared to 300 gallons per minute of flow with a single filter zone. This is accomplished in substantially the same floor space and substantially the same power input. Variations can readily be adopted, such as employing means for obtaining different degrees of filtrate clarity in each zone by varying the apertures of the filters. The amount of washing which occurs in the necessary removal of liquor can be readily balanced by the control of the pressures, rate of flow, rate of rotation of the rotor, and the amount of wash liquid introduced at the various stages.

While the arrangement is primarily used for washing fibers and for the removal of undesirable chemicals, inks, colloidal, dissolved solids and the like, its operation is not limited to that use.

We claimed as our invention:

1. A wood pulp fiber washing device comprising in combination:

a hollow body defining axially extending pressurizable compartments for receiving a slurry flow of pulp fibers in a carrying liquid and provided with a slurry inlet and a slurry outlet;

a first and second stationary annular wash filter disposed coaxially within said body;

said first annular wash filter being disposed radially inwardly and spaced from said second annular wash filter;

channeling means within the body positioned of conduct the slurry axially past one side of the first filter and thereafter in a reverse axial direction past one side of said second filter;

means for generating pulses in said slurry on said side of said filters so that liquid passes through the filters;

means for creating velocity past said and first and second wash filters;

radial velocity generating means for dewatering the pulp stock traveling along said filters; and said first and second wash filters providing barriers to the passage therethrough of pulp fibers influenced by said means for generating pulses, said means for creating axial velocity and said radical velocity generating means; and washing liquid inlet into the body for mixing with the slurry and replacing liquid removed through the filters.

2. A wood pulp fiber washing device constructed in accordance with claim 1:

wherein said means for generating pulses includes a rotatable shell axially disposed within the hollow body, between and spaced from said first and second wash filters.

3. A wood pulp fiber washing device constructed in accordance with claim 2:

in which said shell includes a substantially cylindrical surface having a plurality of outwardly extending projections.

4. A wood pulp fiber washing device constructed in accordance with claim 3:

in which said projections are substantially hemispherically shaped.

5. A wood pulp fiber washing device constructed in accordance with claim 1:

wherein said wash liquid inlet is located to direct wash liquid between said first and second filters.

6. A wood pulp fiber washing device constructed in accordance with claim 1:

wherein said pulse generating means is in the form of a rotor driven in rotation.

7. A wood pulp fiber washing device constructed in accordance with claim 6:

wherein said rotor includes an annular shell rotatably positioned between said first and second wires.

8. A wood pulp fiber washing device constructed in accordance with claim 7:

wherein said shell carries projections for generating pulses in said slurry.

9. A hollow cylindrical body defining axially extending pressurizable compartments therein for receiving a slurry of pulp fibers in a carrying liquid and provided with a slurry inlet and a slurry outlet;

means for generating axial, radial and tangential forces in said slurry;

first and second stationary annularly shaped wash filters disposed axially within said body;

and an annular channeling means within the body positioned between the filters to conduct the slurry axially past one said of the first filter and then in a reverse axial direction past one side of the second filter, said channeling means being driven in rotation.

10. A hollow cylindrical body defining axially extending pressurizable compartments therein for receiving a slurry of pulp fibers in a carrying liquid and provided with a slurry inlet and a slurry outlet constructed in accordance with claim 9 further including:

projections on said channeling means for generating pulses in said slurry to further influence liquid to pass through the filters; and a wash liquid inlet leading into the body for introducing wash liquid to mix with the slurry and displacing liquids in the slurry.

11. A hollow cylindrical body defining axially extending pressurizable compartments therein for receiving a slurry of pulp fibers in a carrying liquid and provided with a slurry inlet and a slurry outlet constructed in accordance with claim 10:

wherein said wash liquid is admitted between said first and second filters.

12. A wood pulp fiber washing device comprising in combination:

an annular hollow body with axially extending pressurizable compartments therein for receiving a slurry flow of pulp fibers in a carrying liquid and provided with a plurality inlet and a slurry outlet;

first and second stationary annular wash filters radially spaced from each other;

a chamber between the filters for conducting liquid drained from the fibers;

means channeling the slurry axially first past the first filter and then in a reverse direction axially past the second filter;

a third annular filter spaced outwardly an coaxially with the first and second filters;

means channeling the slurry after passing the first and second filters axially in a reverse direction past the third filter; and means for inducing radial, axial and tangential velocities in the slurry.

13. A wood pulp fiber washing device constructed in accordance with claim 12:

wherein said means for including includes a first annular shell within the first filter;

a second annular shell between the second and third filters; and means for driving said annular shells in rotation.

* * * * *

UNITED STATES PATENT AND TRADEMARK OFFICE

CERTIFICATE OF CORRECTION

PATENT NO. : 5,538,632

DATED : Jul. 23, 1996

INVENTOR(S) : Gero et al

It is certified that error appears in the above-indentified patent and that said Letters Patent is hereby corrected as shown below:

Column 7, line 17: "of" should read --to--.

Column 8, line 13: "said" should read --side--.

Column 8, line 49: "an" should read --and--.

Column 8, line 58: "including" should read --inducing--.

Signed and Sealed this

Twenty-fifth Day of March, 1997

Bruce Lehman

*Attest:*

BRUCE LEHMAN

*Attesting Officer*

*Commissioner of Patents and Trademarks*